US005287149A

United States Patent [19]

Hoshika

[11] Patent Number: 5,287,149

[45] Date of Patent: Feb. 15, 1994

[54] IMAGE FORMING APPARATUS HAVING IMAGE TRANSFER ELECTRODE CONTACTABLE TO TRANSFER MATERIAL

[75] Inventor: Norihisa Hoshika, Kawasaki, Japan

[73] Assignee: Canon Kabushiki Kaisha, Tokyo, Japan

[21] Appl. No.: 949,214

[22] Filed: Sep. 23, 1992

[30] Foreign Application Priority Data

Apr. 3, 1992 [JP] Japan ..... 4-112221

[51] Int. Cl.[5] ..... G03G 21/00

[52] U.S. Cl. ..... 355/246; 355/208; 355/214; 355/219; 355/271; 355/273; 355/274

[58] Field of Search ..... 355/214, 219, 220, 221, 355/246, 204, 208, 225, 210, 229, 228, 271, 273, 274, 276, 215; 430/902; 361/212, 214, 221, 225, 235

[56] References Cited

U.S. PATENT DOCUMENTS

| | | | |
|---|---|---|---|
| 4,739,363 | 4/1988 | Hoshika et al. . | |
| 4,831,415 | 5/1989 | Kasuya | 355/208 |
| 4,954,843 | 9/1990 | Oka et al. | 355/210 |
| 4,984,026 | 1/1991 | Nishise et al. | 355/277 |
| 5,032,870 | 7/1991 | Yui et al. | 355/219 |
| 5,099,286 | 3/1992 | Nishise et al. | 355/271 X |
| 5,132,738 | 7/1992 | Nakamura et al. | 355/274 |
| 5,150,165 | 9/1992 | Asai | 355/274 |
| 5,151,736 | 9/1992 | Ohzeki et al. | 355/208 |
| 5,182,604 | 1/1993 | Asai | 355/273 |

FOREIGN PATENT DOCUMENTS

| | | | |
|---|---|---|---|
| 0027187 | 3/1981 | Japan | 355/219 |
| 0066581 | 3/1990 | Japan | 355/246 |
| 0233482 | 10/1991 | Japan | 355/274 |
| 2204508 | 11/1988 | United Kingdom | 355/274 |

*Primary Examiner*—Matthew S. Smith

*Attorney, Agent, or Firm*—Fitzpatrick, Cella, Harper & Scinto

[57] ABSTRACT

An image forming apparatus includes an image bearing member for bearing a toner image, movable along an endless path; an original supporting platen for supporting an original: an illumination source for illuminating an original on the supporting platen; an image forming device including a charger, an exposure optical system, including a reciprocable part, for directing a light image of the original on the supporting platen, a developing device and an image transfer device, wherein the reciprocable part moves in a first direction, during an image formation, in which the light image is directed to the image bearing member for image formation thereon and in a second direction, during non-image-formation, for returning the part; wherein the illumination source emits light both during the image formation and during the non-image-formation to direct the light image to the image bearing member, and wherein a developing bias voltage in the developing device is switched depending on whether the apparatus is in the image formation or in the non-image-formation so that an image formed on the image bearing member is not developed by the developing device during the non-image-formation.

8 Claims, 19 Drawing Sheets

IMAGE FORMING APPARATUS HAVING IMAGE TRANSFER ELECTRODE CONTACTABLE TO TRANSFER MATERIAL

FIELD OF THE INVENTION AND RELATED ART

The present invention relates to an image forming apparatus of an electrophotographic type or the like.

An electrophotographic copying machine is known as one of image forming apparatus.

In such a copying apparatus, a surface of a photosensitive drum (image bearing member) is electrically charged by a primary charging device to a predetermined potential, and the charged surface is exposed to image light so that an electrostatic latent image is formed thereon. The electrostatic latent image is developed with toner particles so that a toner image is formed on the photosensitive drum. Opposed to the photosensitive drum, there is provided a transfer charger (transfer means) to transfer the toner image from the photosensitive drum onto a transfer material supplied thereto.

In such a copying machine where the photosensitive member is not exposed to the light image, that is, during non-image-formation period, a blank exposure is effective to expose the photosensitive member to uniform light to erase the electrostatic latent image to prevent toner from being deposited on the photosensitive drum.

The transfer device for transferring the toner to the transfer material is provided with a transfer member to which an image transfer bias is supplied, so that the toner on the photosensitive drum is attracted to the transfer material, from the back side of the transfer material supplied between the transfer member and the photosensitive drum. The transfer charging devices are classified as non-contact type (corona charger) and as contact type, depending on whether the transfer member is pressed to the photosensitive drum with the transfer material therebetween. Recently, the latter contact type charging device is widely used from the standpoint of the reduction of ozone production and the reduction of the applied voltage.

The transfer member is in contact with the photosensitive drum except when the transfer material is present at the transfer station. For this reason, the surface of the transfer member tends to be contaminated with the matters on the photosensitive drum. The contamination is deposited then onto the next supplied transfer material. In order to prevent this back side contamination, the following measurements are taken in the case of so-called regular development system.

(1) Where the photosensitive drum is rotated when the image is not formed on the transfer material (prerotation) intervals between transfer materials, postrotation, which will hereinafter be generally called "non-image-formation period", the surface potential of the photosensitive drum is maintained at 0 V to prevent the deposition of the toner to the transfer member. In one method, the photosensitive drum is exposed to light from a light source for this purpose (blank exposure light source) or a reflection mirror (blank shutter), by which the surface of the photosensitive drum is electrically discharged. In another method, the charging bias of the primary charger is set to 0 V, so as to prevent the charging of the surface of the photosensitive drum. (2) When a toner image having a size larger than the size of the transfer material is formed on the photosensitive drum, the toner image outside the transfer material may be deposited on the transfer member even if the transfer material is supplied in good order. In order to prevent this, the width of the transfer material is detected, and thereafter, side blank exposure is accomplished in accordance with the detected size.

However, these methods are intended to prevent beforehand the deposition of the toner on the surface of the transfer member, and therefore, if the toner is deposited onto the surface of the transfer member for one reason or another, the backside contamination is unavoidable. For example, when the transfer material is not supplied in good order due to transfer material jam or the like, despite the toner image being formed on the photosensitive drum in good order, the surface of the transfer member is contaminated. In order to avoid this by cleaning the surface of the contaminated transfer member, the following methods are known:

(1) The toner is mechanically removed from the surface of the transfer member by a transfer member cleaner.

(2) The transfer member is supplied with a bias voltage of a polarity opposite to that required for transferring the toner onto the transfer material so as to move the toner from the transfer member to the photosensitive drum.

When the images are successively transferred onto the continuously supplied transfer materials, the time usable for the toner removal is not sufficient in the case of the transfer member cleaner, and therefore, it has been difficult to completely remove the toner. For this reason, the second method, the opposite polarity bias application, has been widely used.

However, in the method of cleaning the surface of the transfer material by application of the opposite polarity bias, the surface of the photosensitive drum may be charged to the opposite polarity, as well as the transfer of the toner from the transfer member to the photosensitive drum. The photosensitive drum is maintained charged to the opposite polarity until the primary charging device recharges the surface thereof to the proper polarity for the purpose of next image forming operation. If the surface of the photosensitive drum is charged to the opposite polarity, the photosensitive drum, particularly the OPC drum, is easily deteriorated. In addition, the deterioration increases with an increase of the time in which the surface is charged in the opposite polarity. Therefore, when the transfer member is cleaned in the prior art method, the sensitivity durability of the photosensitive drum, particularly an OPC drum, is easily deteriorated.

SUMMARY OF THE INVENTION

Accordingly, it is a principal object of the present invention to provide an image forming apparatus in which the backside contamination of the transfer material is prevented without increased sensitivity deterioration of the photosensitive drum.

According to an aspect of the present invention, there is provided an image forming apparatus comprising: an image bearing member for bearing a toner image, movable along an endless path; an original supporting platen for supporting an original; an illumination source for illuminating an original on said supporting platen; image forming means including charging means, an exposure optical system, including a reciprocable part, for directing a light image of the original on said supporting platen, developing means and transfer means, wherein the reciprocable part moves in a first direction, during an image formation, in which the light image is directed to said image bearing member for image formation thereon and in a second direction, during non-image-formation, for returning the part; wherein said illumination source emits light both during the image formation and during the non-image-formation to direct the light image to said image bearing member, and wherein a developing bias voltage in said developing means is switched depending on whether said apparatus is in the image formation or in the non-image-formation so that an image formed on said image bearing member is not developed by the developing means during the non-image-formation.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3 is a timing chart of application timing of a bias voltage applied to the primary charger or the like.

FIG. 8 is a timing chart of application timing of a various voltage applied to the primary charger or the like.

FIG. 12 is a timing chart of application timing of a bias voltage applied to the primary charger or the like.

FIG. 17 is a timing chart of a timing of application of a bias voltage to the primary charger or the like.

DESCRIPTION OF THE PREFERRED EMBODIMENTS

Figure 1:
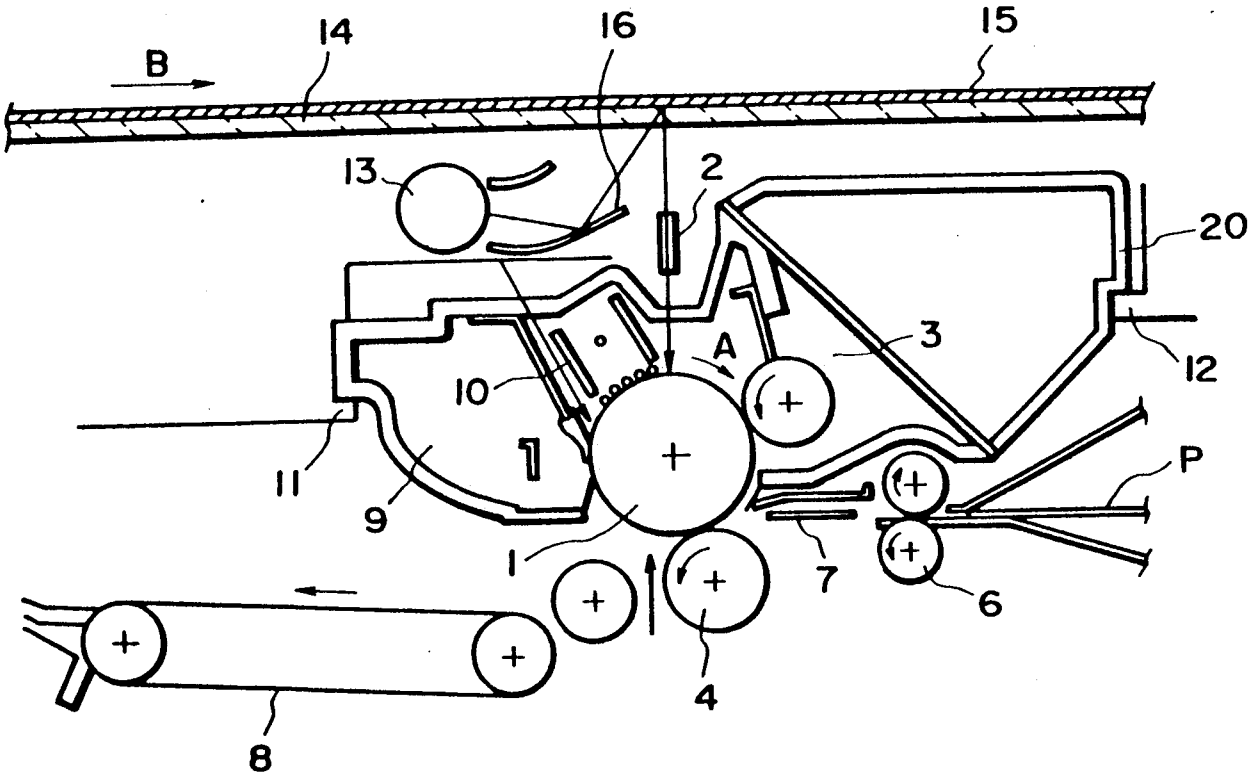
FIG. 1 is a longitudinal sectional view of a copying apparatus according to a first embodiment of the present invention.

Referring to FIG. 1, there is shown a copying apparatus as an exemplary image forming apparatus according to a first embodiment of the present invention. The copying machine incorporates a process cartridge 20, which is detachably mountable to the main assembly of the copying apparatus by moving it unshown rails. When the copying apparatus is loaded with the process cartridge 20, the proper parts of the process cartridge 20 and the proper parts of the main assembly, are mechanically and electrically connected. The process cartridge 20 is provided with a photosensitive drum (image bearing member) which is rotatably supported therein and which comprises an OPC photosensitive layer. When the process cartridge 20 is set in the main assembly the photosensitive drum 1 is rotated by an unshown driving means in a direction A (clockwise direction). Around the photosensitive drum 1, there are provided a primary charger (charging means) 10 for electrically charging the surface of the drum 1 to a potential, a developing device (developing means) 3 containing toner to develop the electrostatic latent image on the photosensitive drum 1 into a toner image, and a cleaning device 9 for removing the residual toner from the photosensitive drum 1. They are disposed in the order named in the rotational direction of the photosensitive drum.

Below the process cartridge 20, a transfer roller (transfer means) 4 is disposed so as to be rotated by the photosensitive drum 1 through the contact therebetween. It is effective to transfer the toner image from the photosensitive drum to the transfer material P. Above the process cartridge 20, there is an exposure device L. The light emitted from an original illumination lamp 13 is directed by a reflection mirror 16 to an original 15 supported on an original supporting platen glass 14, and is reflected by the original 15. The light is then transmitted through a short focus lens array 2 and is imaged on the photosensitive drum, so that an electrostatic latent image is formed on the photosensitive drum 1.

To the right of the main assembly, there is mounted a cassette accommodating a number of transfer materials P, although not shown in the Figure. The transfer material P taken out therefrom is supplied in synchronism with the rotation of the photosensitive drum 1 by timing rollers 6. The transfer material P is passed along the transfer guide 7 so as to be passed through a nip between the transfer drum 1 and the transfer roller 4.

The transfer material P having received the toner image is fed to the downstream side (left side) by a conveying device 8 to a fixing device (not shown), where the toner image is fixed on the transfer material P.

When a switch is actuated by an operator after the original 15 is placed on the platen glass 14, the original illumination lamp 13 is actuated. The emitted light is reflected by the reflection mirror 16 and by the original 15, and is imaged on the photosensitive drum 1 through a short focus lens array 2. The original supporting platen glass 14 supporting the original 15 is moved from left to right in direction B. Since the photosensitive drum 1 is rotating, an image is formed on the photosensitive drum 1. In this embodiment, the original illumination lamp 13 emits the light, also when the platen glass 14 returns from the right position to the original position. Since no blank exposure mechanism such as blank exposure means or blank shutter (reflection mirror) as in the described prior art, is used, the light reflected by the original is imaged on the photosensitive drum 1 through the short focus lens array 2 also when the platen glass 14 moves back in the direction opposite to a direction B.

Figure 2:
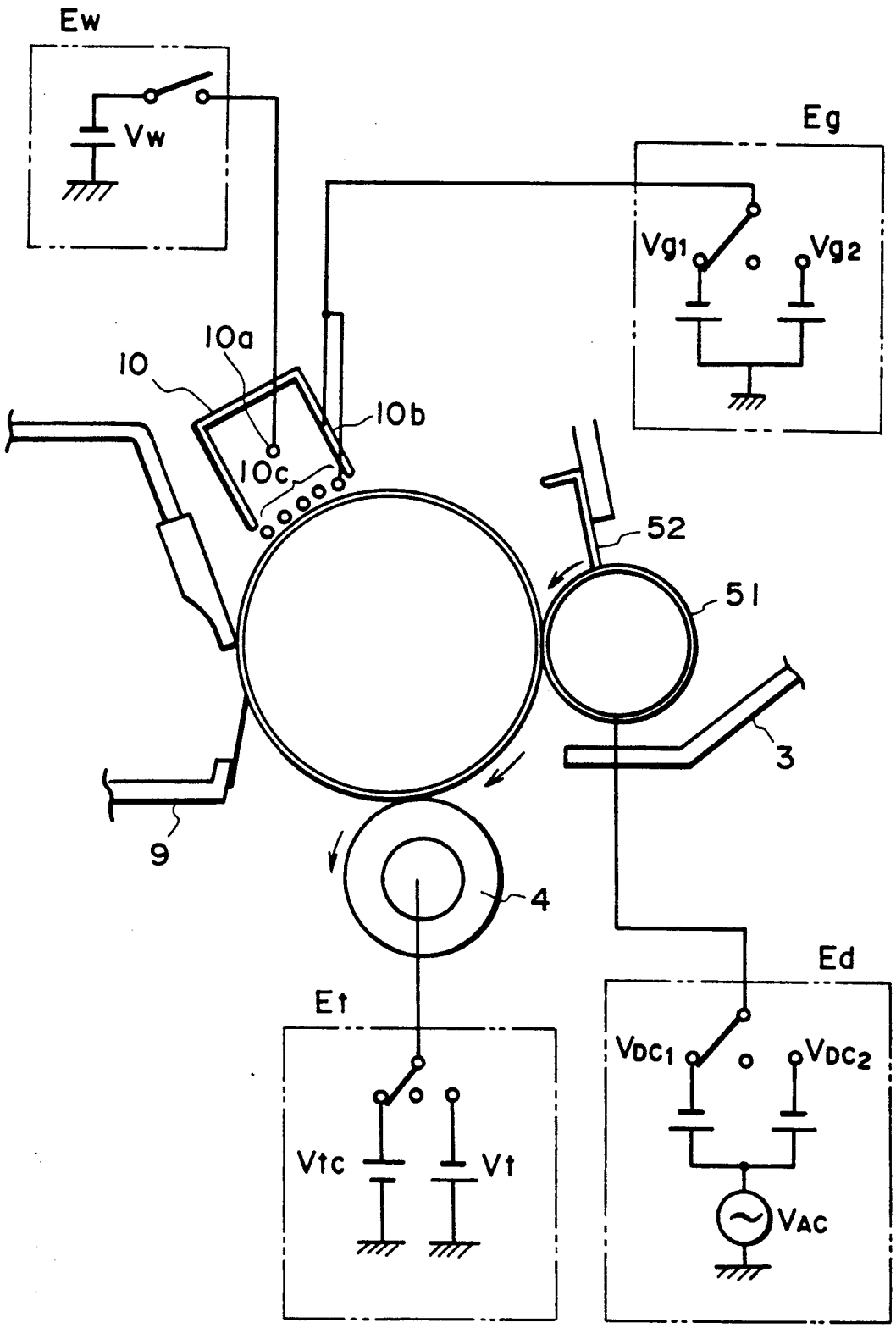
FIG. 2 illustrates power sources or the like connected to a primary charger in the copying apparatus.

Referring to FIG. 2, the description will be made as to the electrical structure in the copying apparatus.

The primary charger 10 has a corona wire 10*a* to which a predetermined voltage Vw is applied by connection thereof to a voltage source (image bearing member surface control means) Ew. The corona wire 10*a* is enclosed with a shield case 10*b*. The shield case 10*b* has a channel-like cross-section with which it is opened only toward the photosensitive drum 1. Between the photosensitive drum 1 and the corona wire 10*a*, a grid electrode 10*c* is disposed. To the shield case 1O*b* and the grid electrode 10*c*, predetermined voltages (grid bias) Vg1 and Vg2 are applied from a voltage source (image bearing member surface control means) Eg, in a proper manner.

The developing device 3 has a developing sleeve 51 for carrying toner particles. To the developing sleeve 51, a developing bias is selectively applied in a proper manner from a voltage source Ed ($V_{AC}+V_{DC1}$, $V_{AC}+V_{DC2}$).

To the transfer roller 4, a voltage source Et is connected, so that opposite polarity transfer bias voltages Vtc and Vt, are selectively applied in proper manner.

Figure 3:
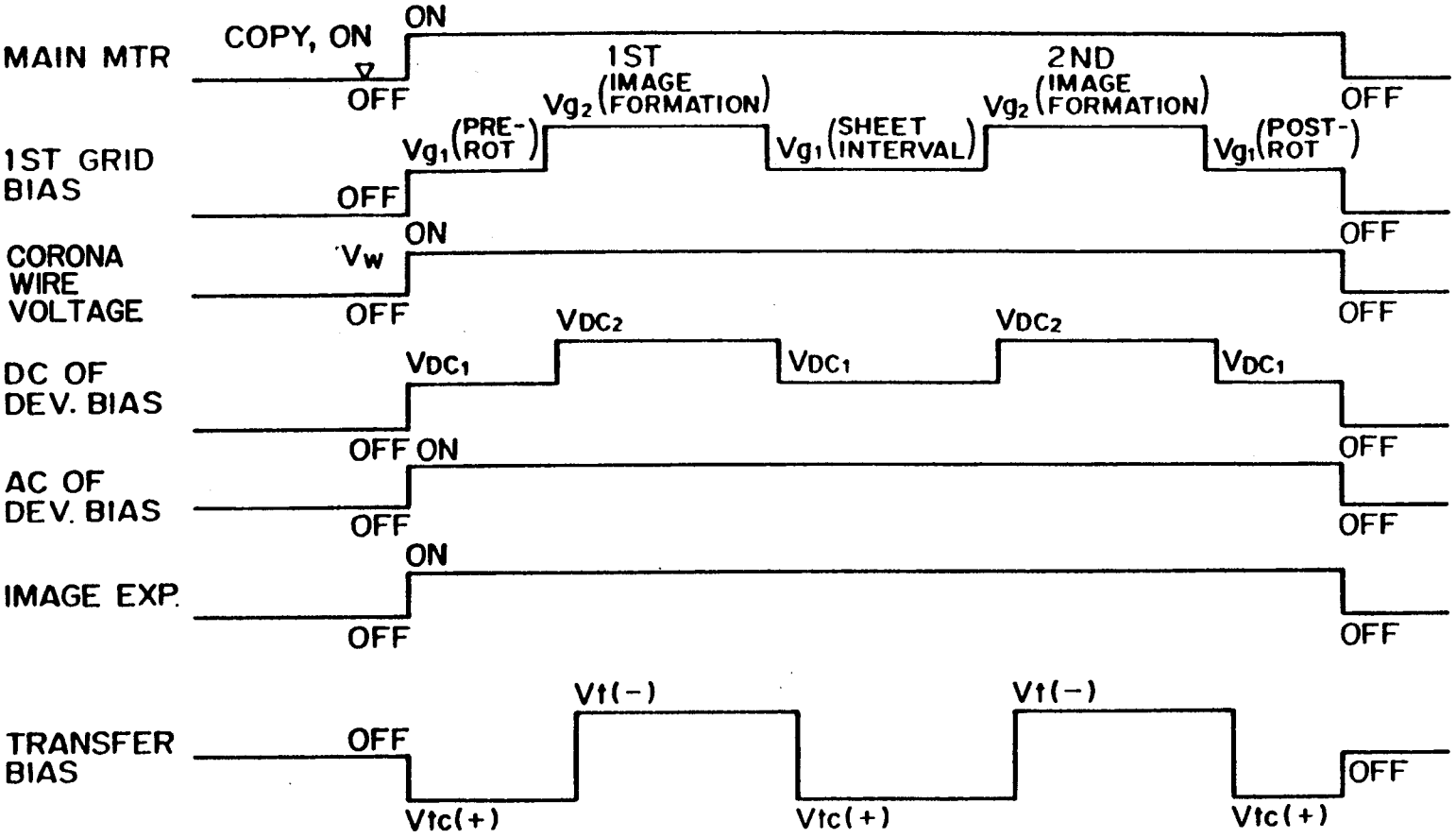

Referring to FIG. 3, the description will be made as to the voltage application timing to the primary charger 10 or the like.

FIG. 3 is a timing chart showing application timing and levels of voltages applied to the primary charger 10 or the like. As shown in the Figure, when a main motor is actuated in response to a predetermined signal input, a pre-rotation of the photosensitive drum 1 starts, the grid electrode 1O*c* is supplied with a grid bias voltage Vg1, and the developing sleeve 51 is supplied with a developing bias voltage in the form of a DC biased AC voltage ($V_{DC1}+V_{AC}$), and the transfer roller 4 is supplied with an image transfer bias voltage Vtc.

During the pre-rotation, the original illumination lamp 13 is energized, so that a light image corresponding to the image of the original 15 is projected onto the photosensitive drum 1 by the exposure device L. Since, however, the voltage Vg1 applied to the grid electrode 10*c* is smaller (same polarity) than the grid bias voltage Vg2 to be applied during the copying operation, the electrostatic latent image formed on the photosensitive drum 1 has a lower contrast. During the pre-rotation period, the opposite polarity transfer bias voltage Vtc functions to transfer the toner having the same polarity as that of the voltage Vtc to the photosensitive drum 1, by which the surface of the transfer roller 4 is cleaned.

When the image forming operation is started after completion of the pre-rotation, the grid bias voltage is increased from Vg1 to Vg2, and therefore, the electrostatic latent image having the proper contrast is formed. The developing bias is switched from $V_{DC1}$ to $V_{DC2}$, in which the voltage $V_{DC2}$ is changeable with a dial in an operation panel of the copying apparatus, so that the resultant image density can be controlled as desired by the operator. The transfer bias Vtc is switched to the voltage Vt having the polarity opposite to that of the toner, so that the toner image formed on the photosensitive drum 1 is transferred onto the transfer material P.

Figure 4:
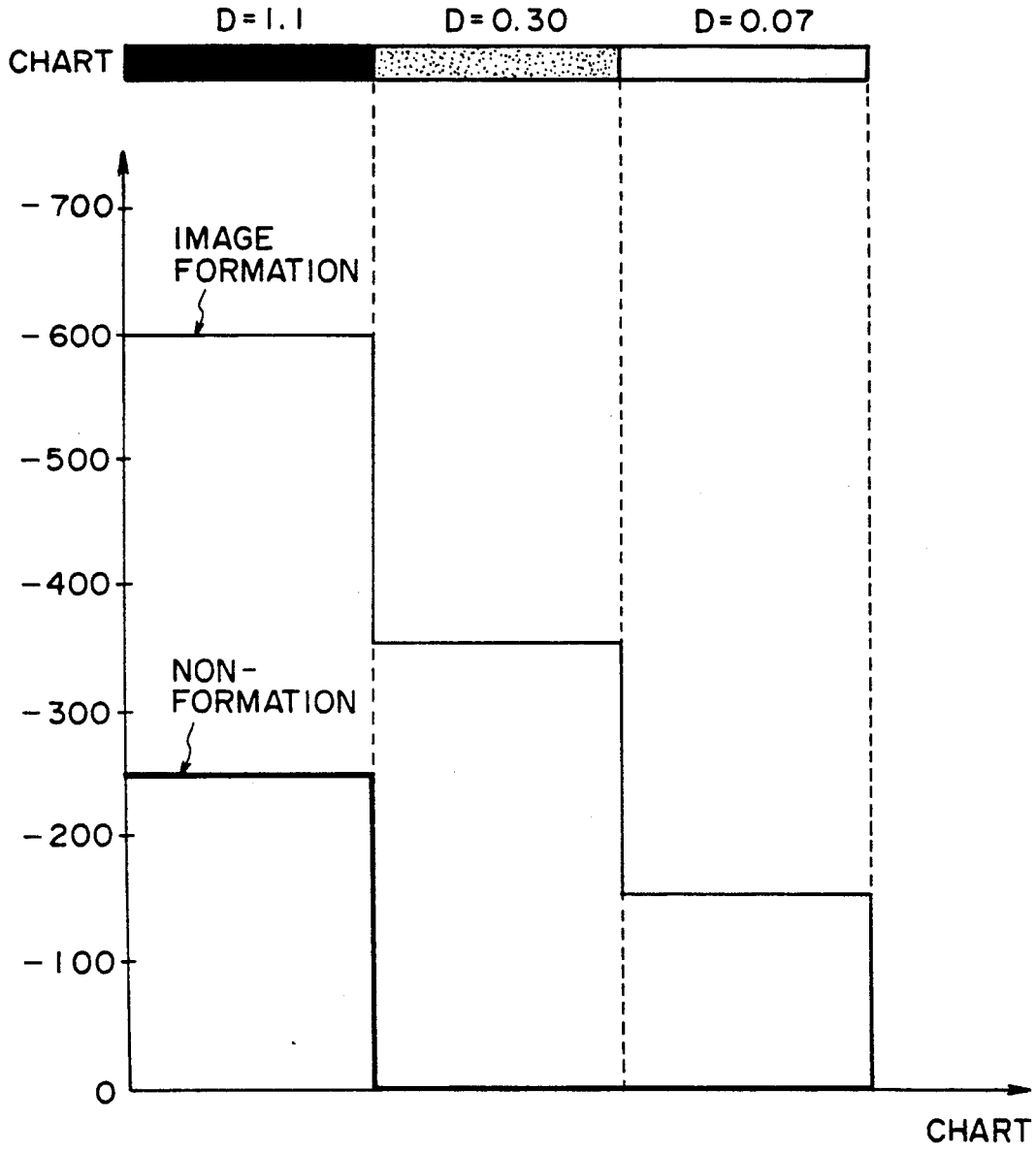
FIG. 4 is a graph of a difference of a surface potential of a photosensitive drum during image formation and non-image-formation (transfer roller cleaning period).

Referring to FIG. 4, the description will be made as to the relationship between the density of the original and a surface potential of the photosensitive drum influenced by the density of the original. The image density level of the original is divided into three levels (D=1.1, 0.30, 0.07). In this Figure, the relationships are shown for the image forming period and the non-image formation period. The grid bias voltage during the non-image-formation period Vg1 is −280 V, and that during the image formation period Vg2 is −630 V.

It will be understood from this figure that the surface potential changes within a range between −600 and −150 V in accordance with the image density, so that a high contrast electrostatic latent image is formed. During the non-image-forming period, the surface potential changes only between 0 and −250 V in accordance with the same image density, and therefore, the contrast is low.

Therefore, if the developing bias voltage $V_{DC1}$ during the non-image-forming period exceeds −250 V (in the negative direction), the toner is hot transferred onto the transfer drum since the toner is charged to the positive polarity, in the case of a regular development. As a result, the contamination of the transfer roller 4 can be avoided.

Figure 5:
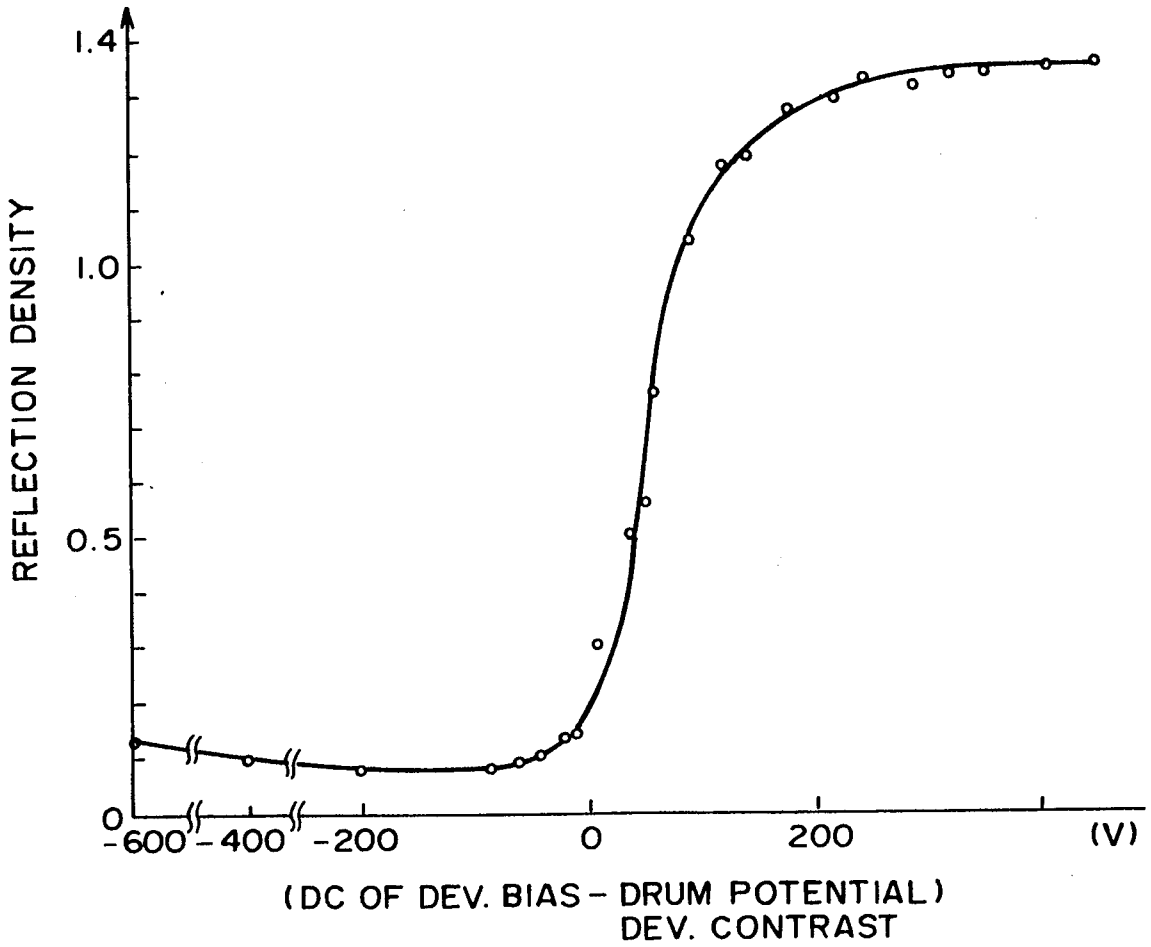
FIG. 5 shows a relationship between a development contrast and a reflection density.

Referring to FIG. 5, the description will be made as to the proper level of the developing bias voltage $V_{DC1}$.

FIG. 5 shows the relationship between a development contrast and a reflection image density of the toner image. It will be understood from the Figure, the developing action starts in the regular direction if the development contrast exceeds −30 V and increase in the positive direction. If the development contrast increase beyond −400 V in the negative direction, negatively charged toner particles (they are mixed in the toner particles in the developing device 3, although the amount is small), are transferred onto the transfer drum (reverse fog). In order to prevent this, the development contrast is preferably −30 V - −400 V.

The development contrast is a potential difference between the surface potential of the photosensitive drum and the developing bias voltage. The surface potential of the photosensitive drum is 0 - −250 V in this embodiment, as described in conjunction with FIG. 4, and therefore, the developing bias voltage $V_{DC1}$ is selected to be −280 - −400 V.

FIG. 5 shows a V-D curve in the case of a jumping developing method using a non-magnetic and one component toner. In this case, as long as the negative direction of the development contrast is concerned, it will suffice if only the reverse fog is noted. In the case of two component magnetic brush development, there is a problem of carrier deposition on the photosensitive drum, and therefore, the contrast in the negative direction is preferably not more than −200 V which is smaller than −400 V.

As will be understood from FIG. 4, the latitude of selection of the developing bias voltage $V_{DC1}$ decreases with increase of the potential during the non-image forming period in the negative direction, and therefore, it is preferably less than −400 V, more particularly, it is preferably less than the grid bias voltage Vg2 = −430 V.

By doing so, the photosensitive drum charged to the opposite polarity is immediately re-charged to the proper side polarity by the primary charger 10, and therefore, the sensitivity deterioration due to the opposite polarity charging of the photosensitive drum, can be minimized.

Even if an electrostatic latent image is formed on the photosensitive drum by application of light from the original to the photosensitive drum during cleaning operation of the transfer roller 4, the toner deposition on the photosensitive drum can be prevented. For this reason, further contamination of the transfer roller 4 is prevented, and the unnecessary consumption of the toner can be prevented. As a result, the necessity for a special mechanism for stopping the image exposure during the cleaning of the transfer roller 4 can be eliminated.

Referring to FIGS. 6, 7, 8 and 9, a further embodiment of the present invention will be described. The same reference numerals as in FIGS. 1-5 are assigned to the elements having the corresponding functions, and the detailed descriptions thereof are omitted.

Figure 6:
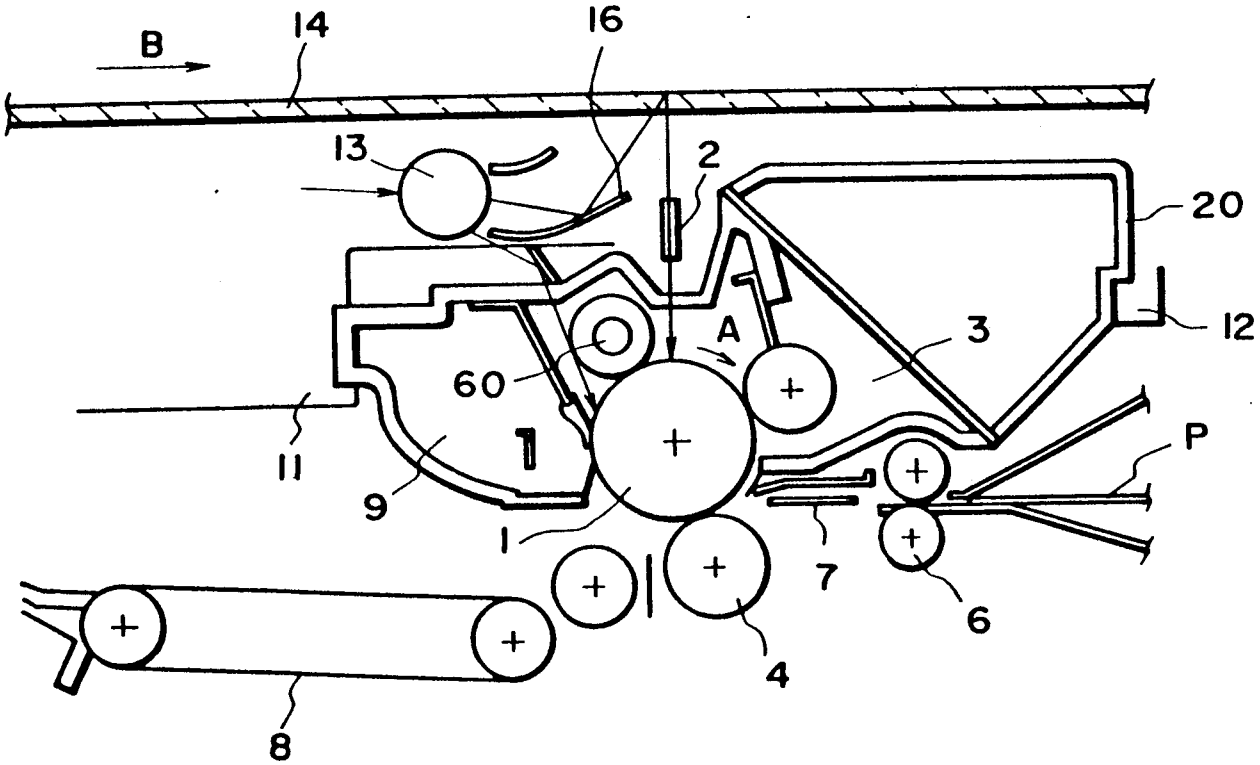
FIG. 6 is a longitudinal sectional view of the general structure of an image forming apparatus according to another embodiment of the present invention.
Figure 7:
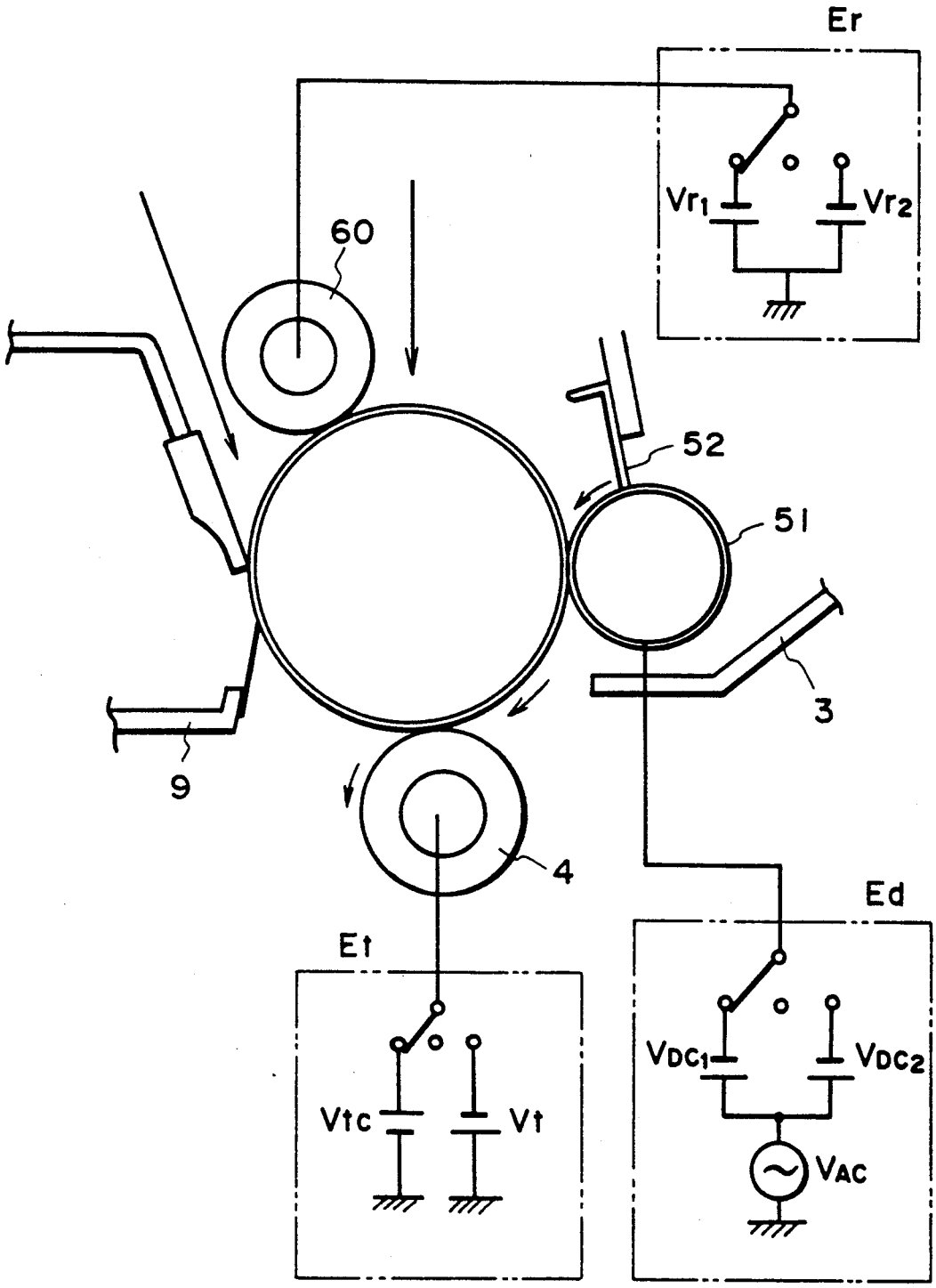
FIG. 7 illustrates a power source or the like connected to a primary charger or the like in the copying machine.
Figure 8:
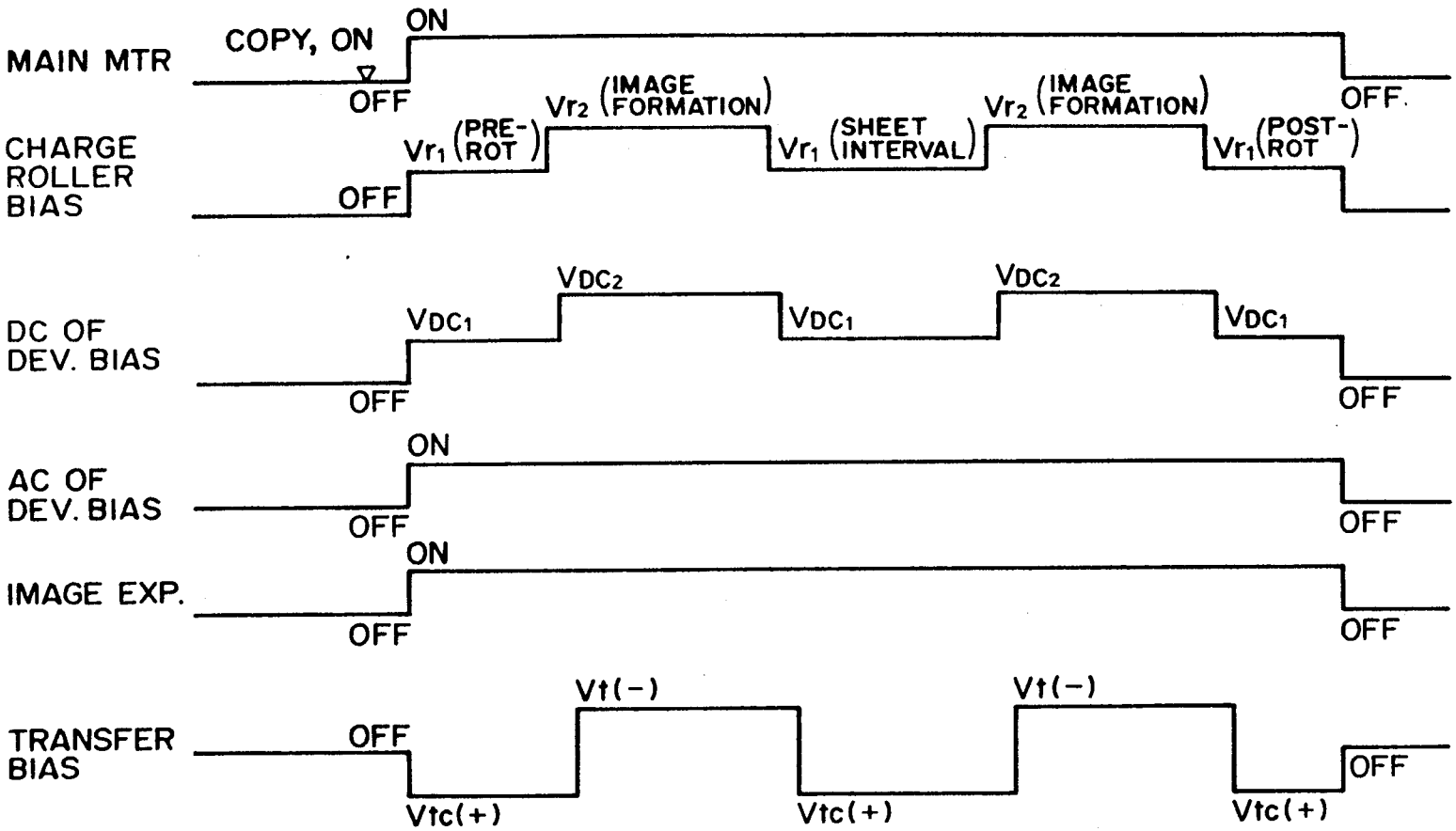
Figure 9:
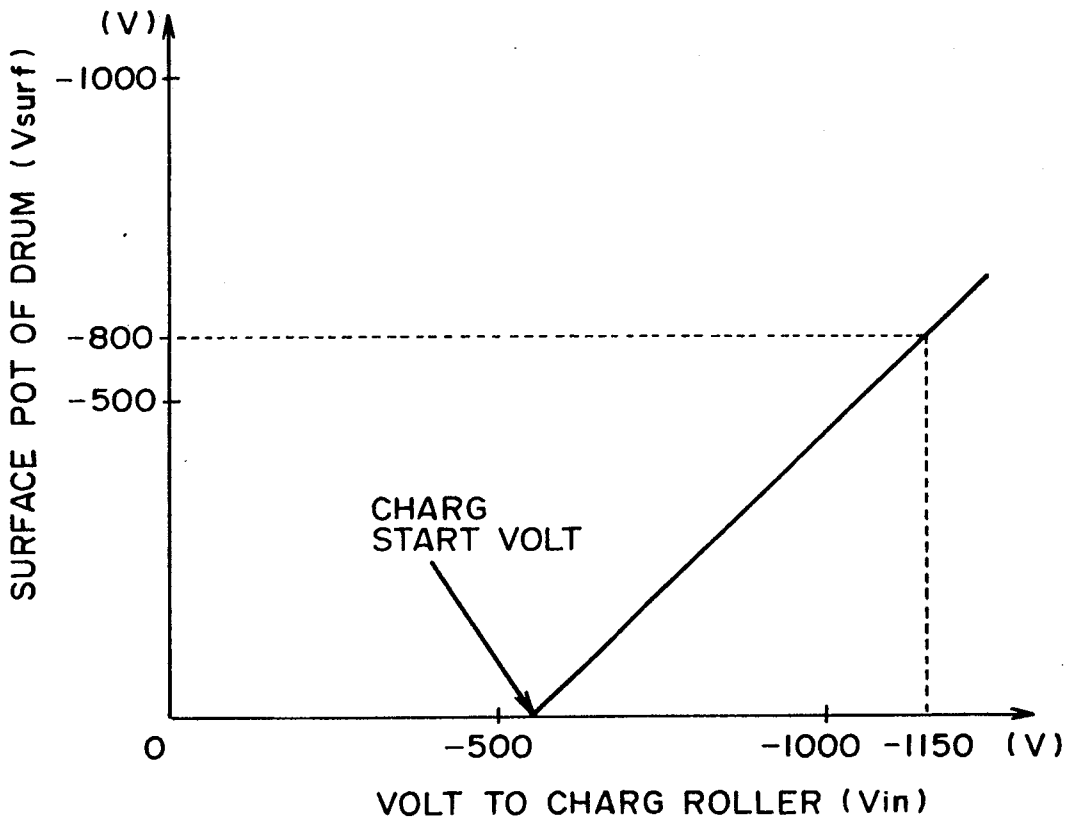
FIG. 9 is a graph of a relationship between the surface potential of the photosensitive drum and the voltage applied to the charging roller.
Figure 10:
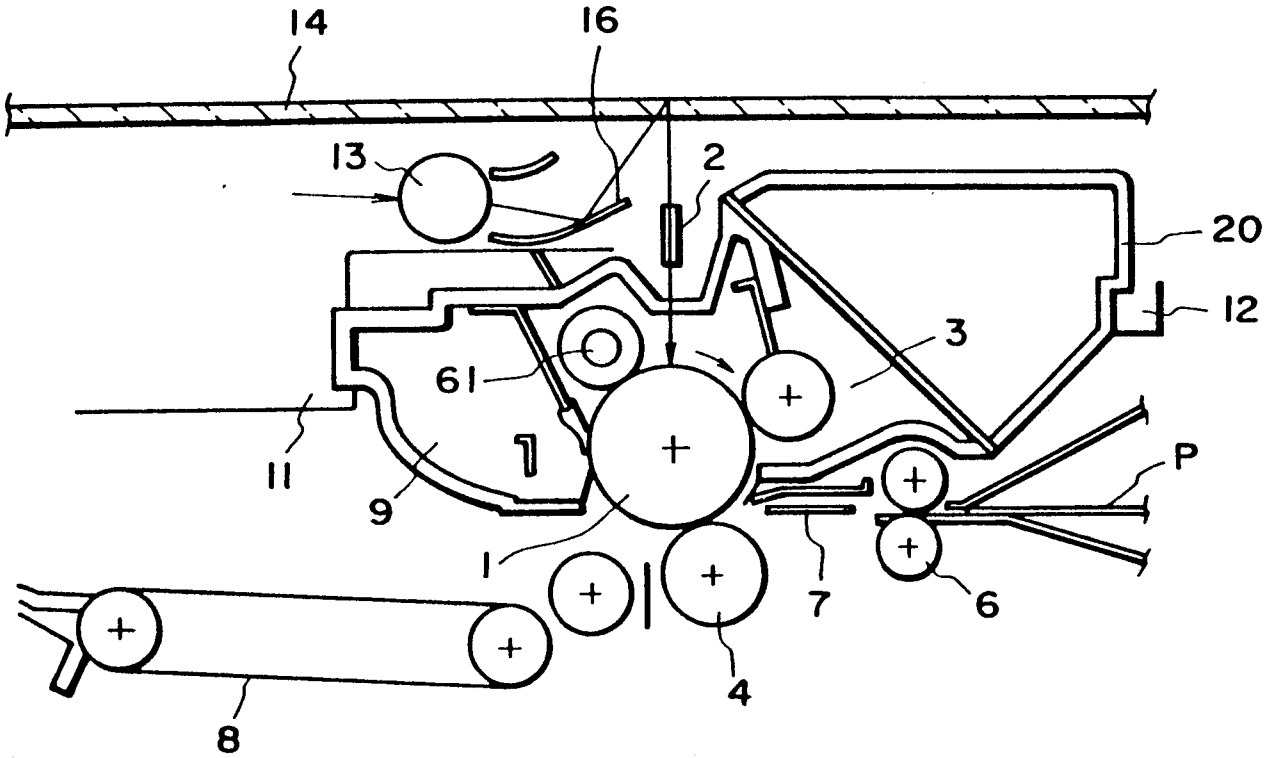
FIG. 10 is a longitudinal sectional view of a general structure of a copying machine according to a further embodiment of the present invention.
Figure 11:
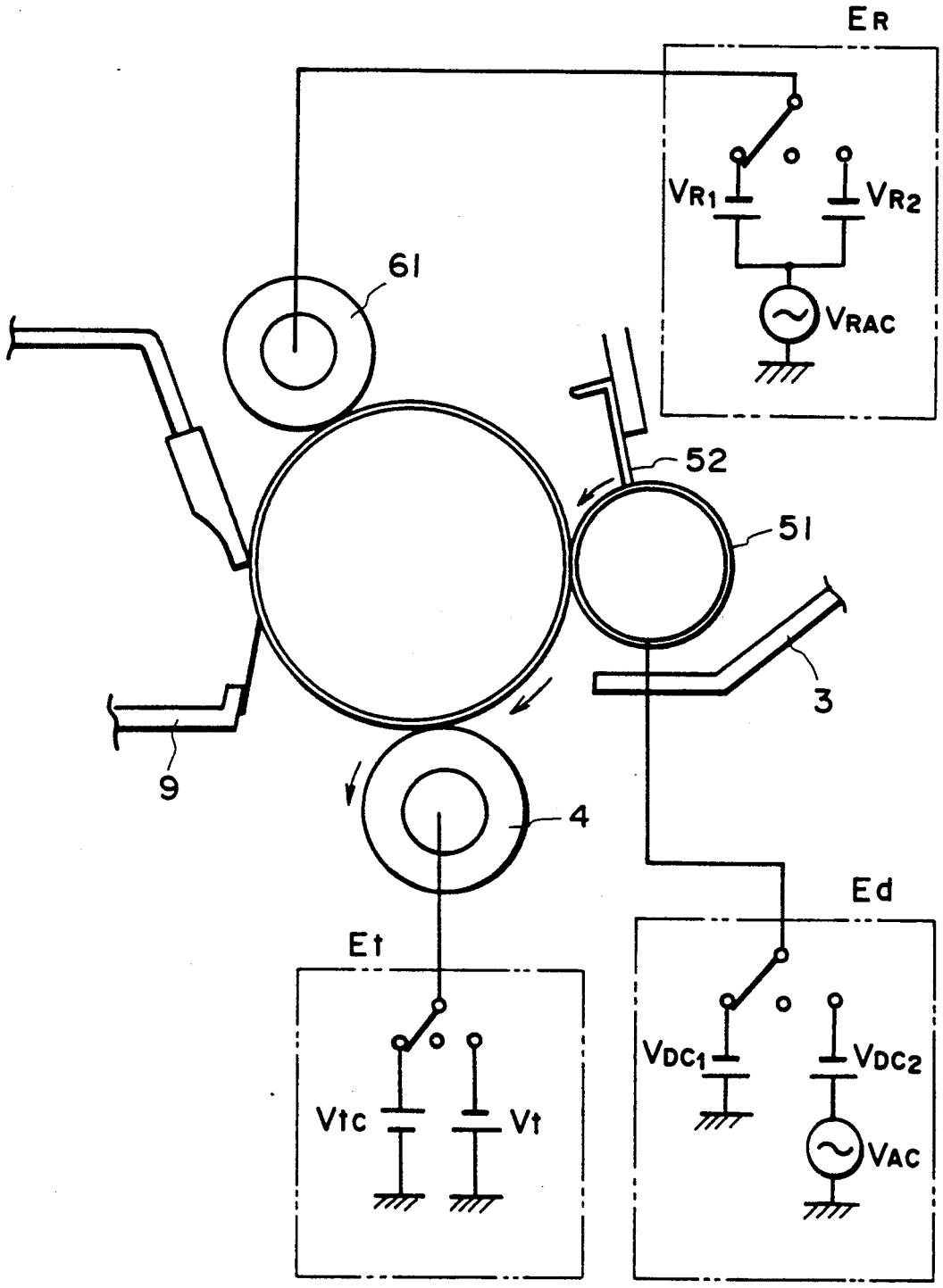
FIG. 11 illustrates power sources or the like connected to the primary charger or the like in the copying machine.

In this embodiment, the primary charger is a contact type charging roller 60. FIGS. 6 and 7 show structures of the copying apparatus using the charging roller 60. The charging bias voltage applied to the charging roller 60 is Vr1 during the non-image formation period, and it is Vr2 during the image forming period. It is switched in the two stages as in the case of the grid bias voltages Vg1 and Vg2. The voltages satisfy Vr1<Vr2, and the application timing is as shown in FIG. 8. When a charging bias applied to the charging roller 60 is a DC voltage, it is usual that the voltage is a charge starting voltage plus a dark portion potential. FIG. 9 shows that the charging bias voltage is −1150 V when the charge starting voltage and the dark portion potential are −550 V and −660 V, respectively.

When the inventor measured the surface potential of the photosensitive drum during the non-image formation period, it was 0 - −180 V. If the developing bias voltage is selected so that the development contrast is between −300 V and −400 V, toner deposition on the photosensitive drum can be prevented. Therefore, it will suffice if the developing bias is set to be −210 - −400 V.

BY doing so, the ozone production by the primary charger can be reduced, and therefore, the service life of the photosensitive drum is expanded. In addition, the necessity for an air discharging fan and/or an ozone filter may be eliminated, and therefore, the structure of the apparatus is simplified, in addition to the advantageous effects of the foregoing embodiment.

Since the photosensitive drum charged to the opposite polarity is immediately re-charged to the proper polarity by the primary charging device 10, and therefore, the sensitivity deterioration due to the charging of the photosensitive drum to the opposite polarity, can be minimized.

Additionally, even if the reflected light from the original is applied on the photosensitive drum during the cleaning of the transfer roller 4, and an electrostatic latent image is formed on the photosensitive drum, the deposition of the toner on the photosensitive drum can be avoided. Therefore, the transfer roller 4 is prevented from a further contamination And, the unnecessary consumption of the toner can be avoided. As a result, the necessity for a particular mechanism for stopping the image exposure during the cleaning of the transfer roller 4, can be eliminated.

Referring to FIGS. 10, 11, 12 and 13, a further embodiment will be described. The same reference numerals as in FIGS. 1-9 are assigned to the elements having the corresponding functions, and the detailed descriptions thereof ar omitted for simplicity.

Figure 13:
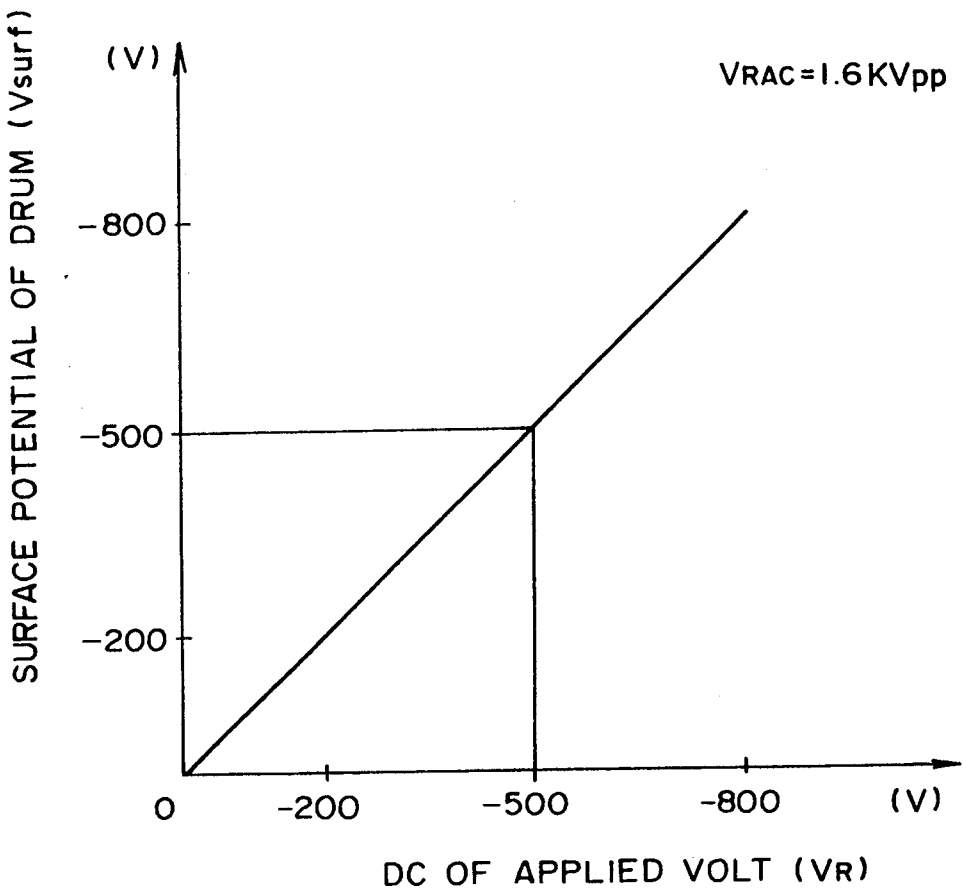
FIG. 13 is a graph of a relationship between the surface potential of the photosensitive drum and a voltage applied to the charging roller.

In this embodiment, the charging bias applied to the transfer roller 16 is in the form of an AC voltage $V_{RAC}$ biased with a DC voltage $V_R$. The AC voltage $V_{RAC}$ has a peak-to-peak voltage which is not less than twice the charge starting voltage. The DC voltage $V_R$ is proportional to the surface potential $V_{SURF}$ of the photosensitive drum, as shown in FIG. 13.

Figure 12:
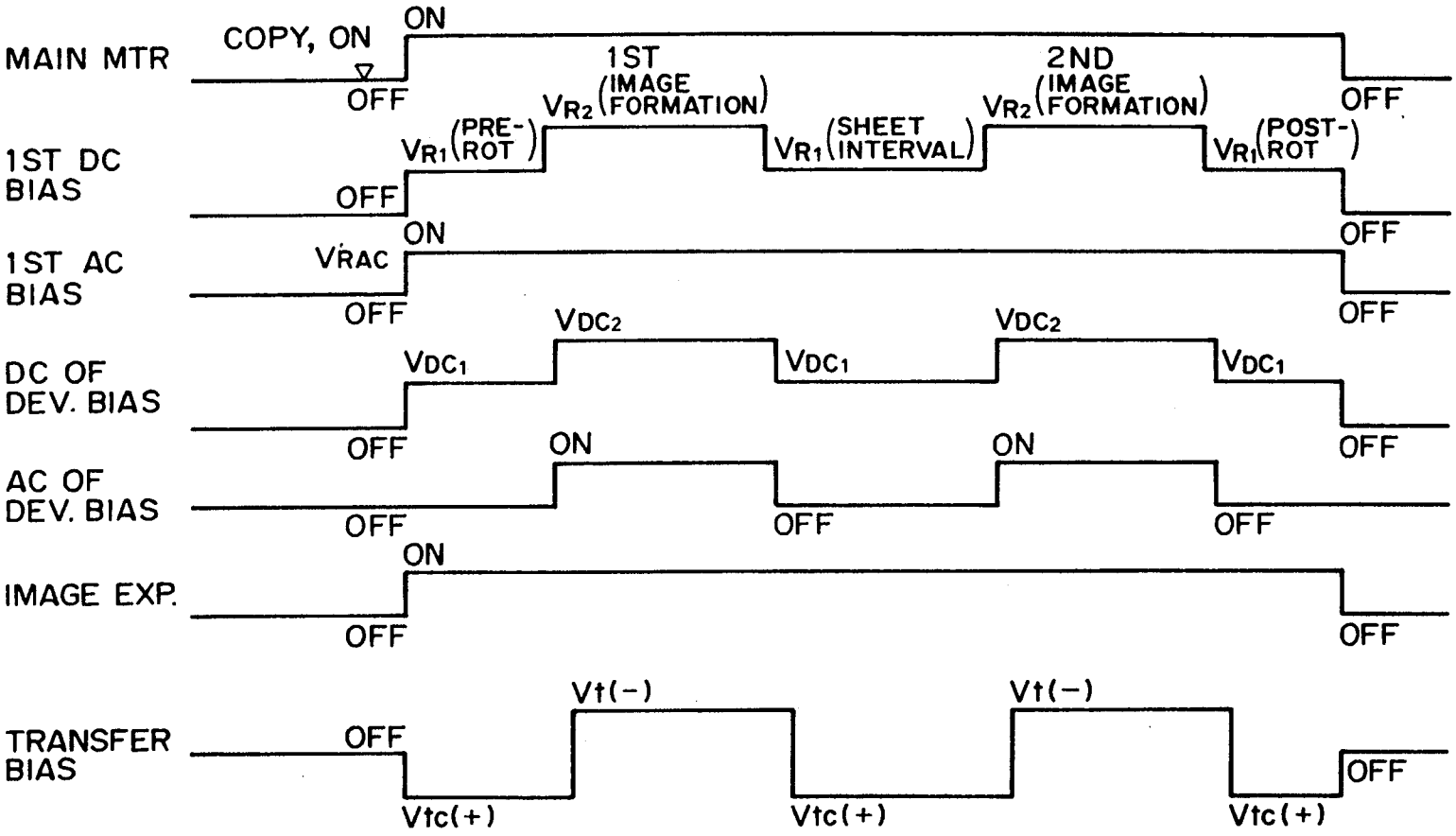

The AC component $V_{RAC}$ is contained constant, and the DC voltage component is switched between $V_{R1}$ for the non-image formation period and $V_{R2}$ for the image formation period, so that the two stage switching is possible as in the foregoing embodiments. The voltages satisfy $V_{R1}<V_{R2}$ (the same polarity), and the application timing is as shown in FIG. 12.

In this embodiment, $V_{R1}=-250$ V, $V_{R2}=-600$ V, $V_{RAC}=1.6$ KVpp (400 Hz (sine wave)), and $V_{DC1}$ (the DC component of the developing bias during the non-image-formation period)=300 V.

At this time, the potential of the photosensitive drum is 0 - −230 V during the non-image-formation period, and the development contrast is −70 V - −300 V. This is between the proper development contrast range described hereinbefore (−400 V - −30 V), and therefore, the toner is not wasted during the non-image-formation period.

In addition to the same advantageous effects, the surface potential of photosensitive drum can be made uniform without so-called pre-exposure, since the primary charger is of a contact type using an DC biased DC voltage.

In the foregoing embodiment, the developing bias voltage is in the form of a DC biased DC voltage, and the DC voltage component is actuated during the non-image formation period. However, by rendering off the AC voltage, the possibility of the toner deposition can be further reduced.

In the foregoing embodiment, a transfer roller is used, but it is not limiting. It may be in the form of a brush or contact type charger.

In addition, the image bearing member is in the form of a photosensitive drum in the foregoing embodiment. This is not limiting, either. It may be in the form of a belt which may or may not have a seam. When it has a seam, the synchronization between the photosensitive member rotation and the image forming operation may be established so as to form the image other than the seam.

Referring to FIGS. 14, 15, 16, 17, 18 and 19, a further embodiment will be described. The same reference numerals as in FIGS. 1-13, are assigned to the elements having the corresponding functions, and the detailed description thereof are omitted for simplicity.

Figure 14:
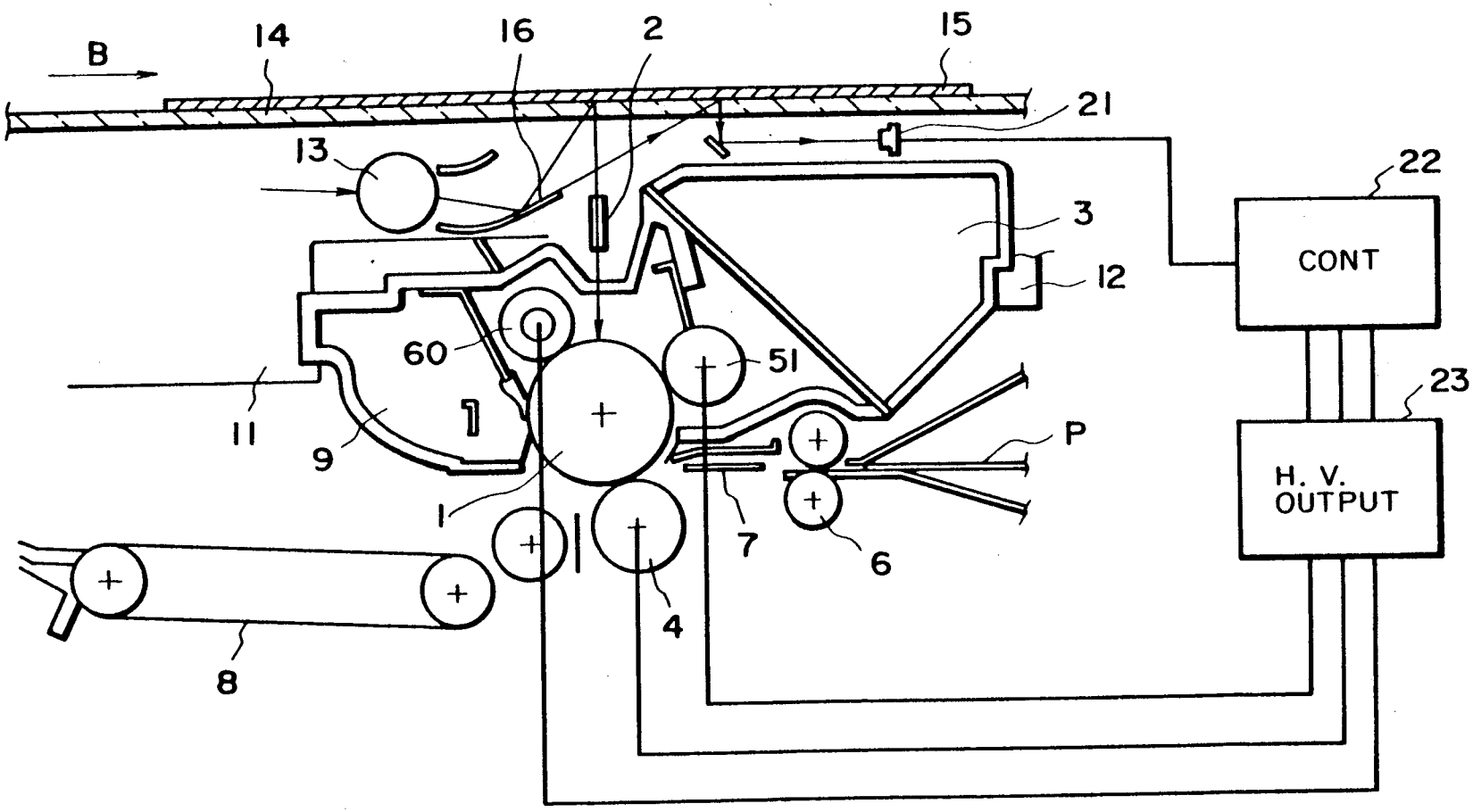
FIG. 14 is a longitudinal sectional view of a copying apparatus according to a further embodiment of the present invention.

FIG. 14 is a longitudinal sectional view of a copying apparatus according to this embodiment of the present invention. A part of the light reflected from the original 15 after being emitted from the original illumination lamp 13, is incident on a reflected light sensor (density detecting means) 21. The reflected light sensor 21 is electrically connected with a controller 22 of the copying apparatus including a CPU. The controller 22 produces an output control signal to a high voltage generator 23 on the basis of a signal from the light sensor 21 to control the bias voltage levels to be applied to the charging roller 60, the developing device 3 and the transfer roller 4.

Figure 15:
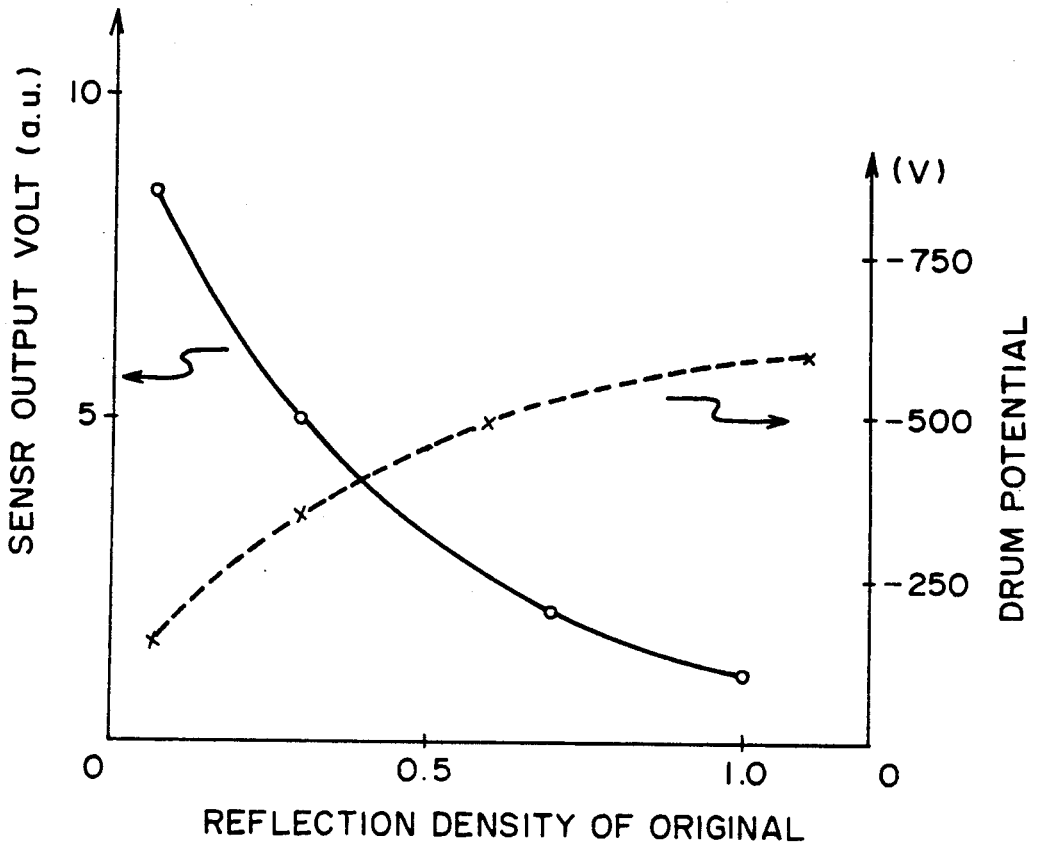
FIG. 15 is a graph of a relationship between a reflection density of an original and a sensor output voltage or a photosensitive drum potential.
Figure 16:
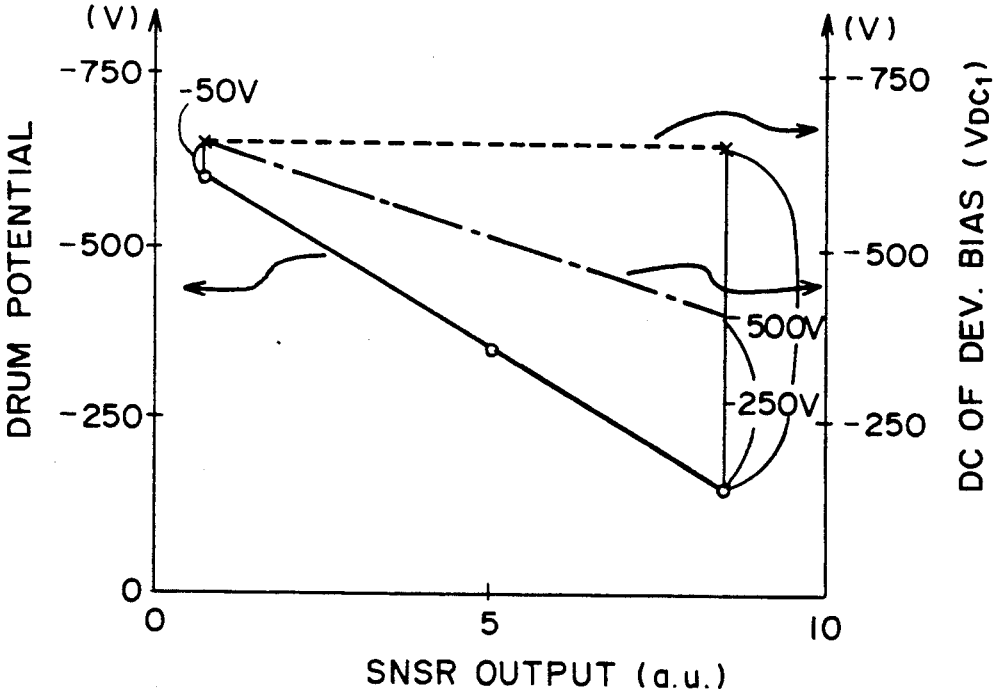
FIG. 16 is a graph of a relationship between a sensor output voltage and a DC component of a developing bias voltage.

Referring to FIGS. 15 and 16, the description will be made as to the output voltage of the light sensor 21 and the surface potential of the photosensitive drum. FIG. 15 shows a relationship between a reflection density (image density) of the original and an output voltage of the light sensor 21 in a solid line, and the relationship between the reflection density of the original and the surface potential of the photosensitive drum, is shown by a broken line. It will be understood that there is one-two-one relation, respectively, so that with the increase of the reflection density of the original, output voltage of the sensor decreases, and the surface potential of the photosensitive drum increases.

FIG. 16 shows a relationship between the output voltage of the sensor and the surface potential of the photosensitive drum, determined from the relationship shown in FIG. 15. In FIG. 16, the sensor output voltage corresponds one-to-one to the potential of the photosensitive drum in a one order function. Therefore, if the sensor output voltage is known, the potential of the photosensitive drum is known. However, the image information of the reflected light incident on the sensor 21 is deviated in time from the image information of the reflected light incident on the photosensitive drum 1 through the short focus lens array 2. The reason is as follows. As shown in FIG. 14, the light incident on the photosensitive drum 1 at a time is the one reflected by a portion X of the original 15, and the light incident on the reflected light sensor 21 at the same time is the one reflected by a portion Y. Therefore, it is when the original platen glass 14 has moved through a predetermined distance that the sensor 21 detects the light reflected by the portion X. The description of the original here has a uniform density. Actually, however, the original has character or photograph image or solid black image in mixture, and it is not possible to correctly catch the delicate potential of the photosensitive drum only on the output of the sensor. However, in the case of a dark original or an original having a large solid black image portion, the output of the sensor is small, and on the other hand, when the original has low image density, or large white portion, the sensor output is large. Therefore, it reflects the surface potential of the photosensitive drum, generally.

The charging bias applied to the charging roller 60 is in the form of an AC voltage $V_{RAC}$+DC voltage Vr. The developing bias applied to the developing device 3 is in the form of a DC voltage $V_{DC}$ + AC voltage $V_{AC}$, similarly to the foregoing embodiments.

Figure 17:
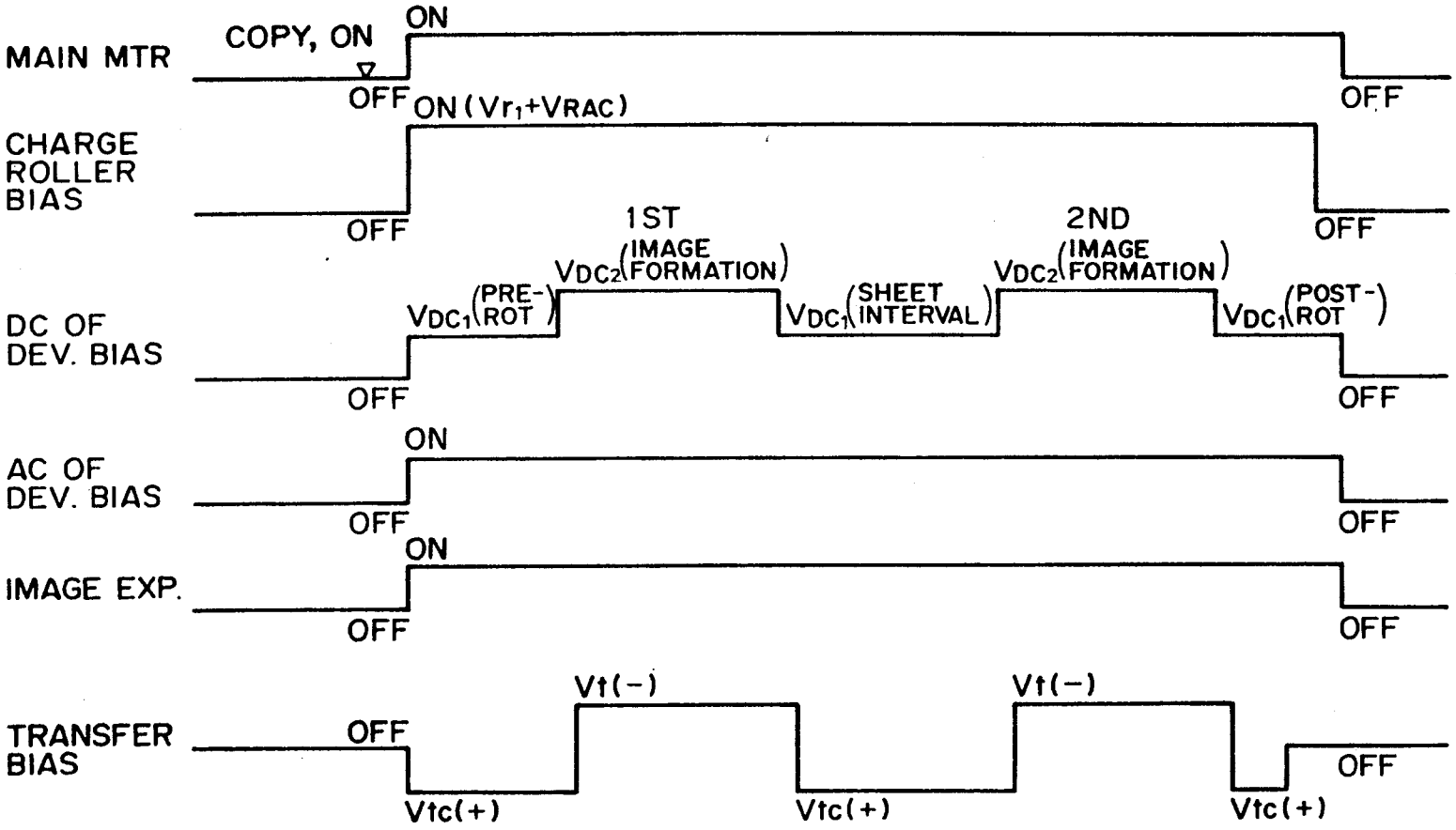

FIG. 17 shows the bias voltage application timing or the like as in FIGS. 3, 8 and 12. As shown, in this embodiment, when the pre-rotation of the photosensitive drum starts, the charging roller 60 supplied with a bias voltage Vr1+$V_{AC}$ (the same level as in the image formation period), starts to uniformly charge the surface of the photosensitive drum, and the developing bias is set to $V_{DC1+VAC}$.

In this embodiment similarly to the foregoing embodiments, the photosensitive drum is exposed to the light reflected by the original, and therefore, the surface potential of the photosensitive drum changes with the density of the original image (broken lines in FIG. 15). When the voltage Vr1 is −630 V, the output voltage of the light sensor 21 is as shown by a solid line in FIG. 16, depending on the potential of the photosensitive drum. Here, the DC component of the developing bias voltage ($V_{DC}$) is changed as shown by a chain line in FIG. 16 in accordance with the output voltage of the sensor 21. However, the potential of the photosensitive drum represented by the output of the sensor does not exactly correspond to the surface potential of the portion of the photosensitive drum faced to the developing device (developing zone) at this time. In view of the time difference, it is preferable that when the portion of the photosensitive drum surface sensed by the sensor comes to the developing zone, the DC component of the developing bias ($V_{DC}$) is changed to the level corresponding to the sensor output shown in FIG. 16. By changing the DC component ($V_{DC}$) of the developing bias in accordance with an output of the sensor 21, the contrast between the photosensitive drum potential and the developing bias potential can be made −50 - −250 V, approximately.

In this embodiment, the relationship between the development contrast and the reflection density, is also as shown in FIG. 5. Therefore, it is desirable that the development contrast is between −30 V and −400 V. In this embodiment, in accordance with the sensor output, the developing bias voltage $V_{DC1}$ is changed, so that the above range is satisfied. Therefore, the positive or reversed fog is small during non-image-formation period. If the $V_{DC1}$ is fixed at −650 V as shown in FIG. 16, the surface potential of the photosensitive drum becomes −150 V when a thin original (white original) is used, with the result of −500 V of the contrast, and therefore, reversed fog increased.

As described in the foregoing, by changing the DC component of the development bias in accordance with an output of the reflected light sensor 21 for detecting the level of the strength of the light reflected by the original during non-image-formation period, both of the positive and reversed fog are prevented. Thus, the same advantageous effects as in the foregoing embodiments can be provided.

The charging bias applied to the charging roller 60 may be made constant irrespective of the image formation, and therefore, the sequential operation control is simplified.

Figure 18:
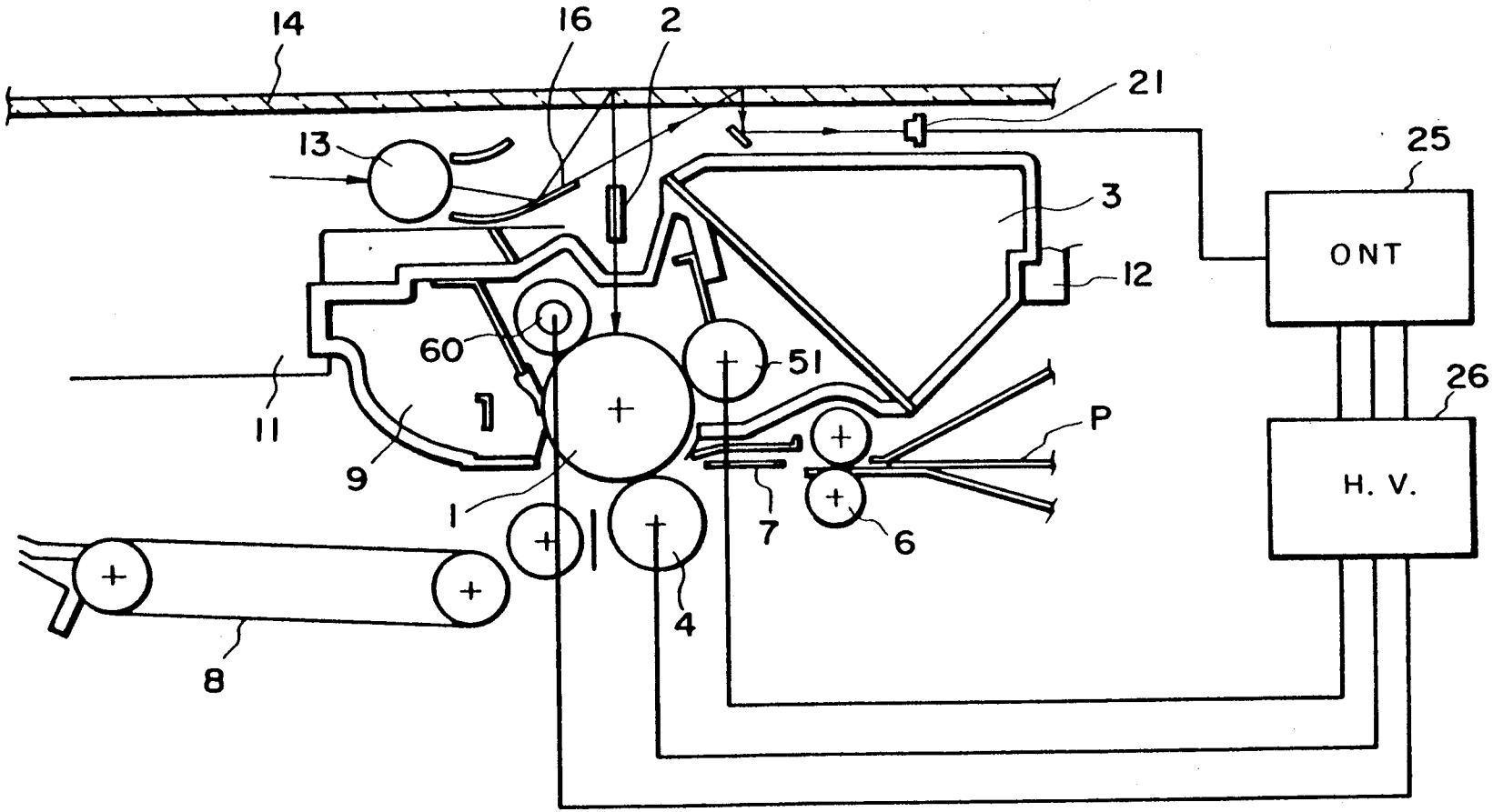
FIG. 18 is a longitudinal sectional view of a copying apparatus according to a yet further embodiment of the present invention.
Figure 19:
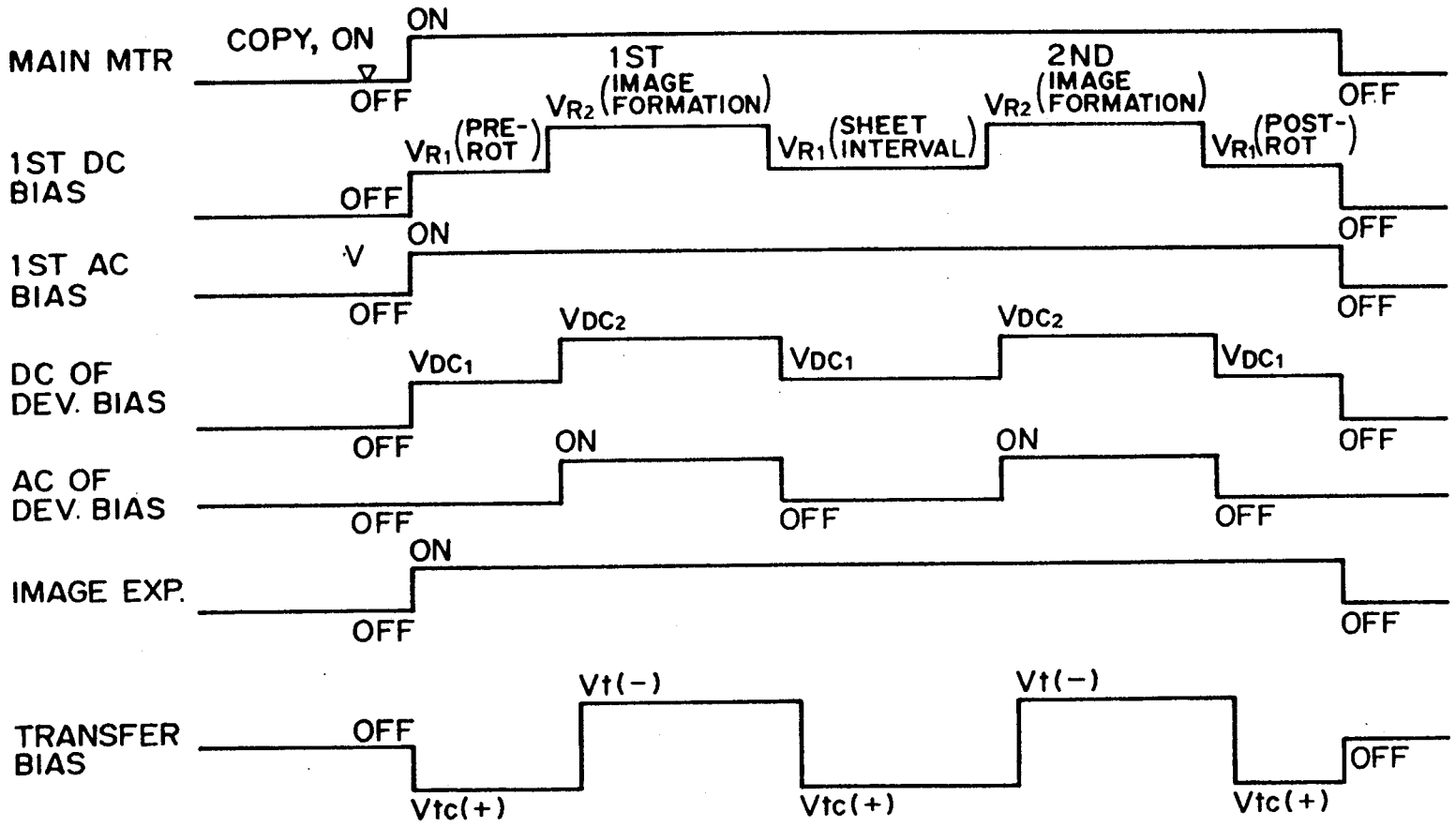
FIG. 19 is a timing chart showing application timing of a bias voltage applied to the primary charger or the like FIG. 20 is a graph showing a relationship between a sensor output voltage and a primary DC bias.
Figure 20:
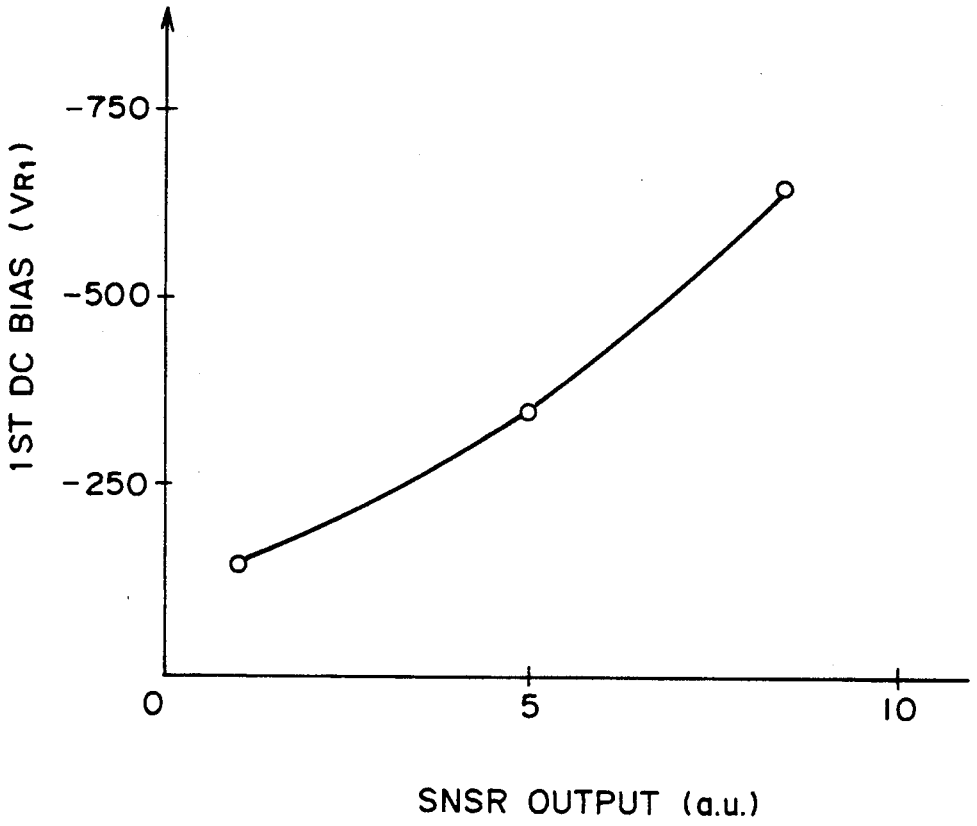

Referring to FIGS. 18, 19 and 20, a further embodiment will be described. FIG. 18 is a longitudinal sectional view of a copying apparatus according to this embodiment. The apparatus of this embodiment has the same structure as in the foregoing embodiments, except for the controller 25 and the high voltage generator 26, and therefore, the detailed description of the common parts are omitted for simplicity.

FIG. 19 shows an application timing or the like of the bias voltage applied to the charging roller 60. During the pre-rotation of the photosensitive drum, the charging roller 60 is supplied with Vr1+$V_{AC}$, and the developing device 3 is supplied with $V_{DC1}$. The developing bias $V_{DC1}$ is constant, as contrasted to the foregoing embodiments.

The charging bias $V_R$1 is changed in accordance with an output of the reflected light sensor 21. FIG. 20 shows a relationship between an output voltage of the sensor and the voltage $V_R$1. The charging bias voltage $V_R$1, as shown in FIG. 20, is large when the sensor output voltage is large (white original), and it is small when the sensor output voltage is small (white original).

As shown in FIG. 20, the charging bias voltage $V_R1$ is changed in accordance with an output of the light sensor 21, by which the surface potential of the photosensitive drum when it passes by the image exposure position is set to be −150 V, by proper adjustment. Therefore, if the developing bias voltage $V_{DC}$ is constant (−200 - −400 V), the contrast between the surface potential of the photosensitive drum and the developing bias is −50 - −250 V. Therefore, the positive or reversed fog is small even during non-image-formation period.

By changing the DC component ($V_R1$) of the charging bias voltage in accordance with an output of the reflected light sensor 21, both of the positive and reverse fog can be prevented, and therefore, the unnecessary toner deposition onto the photosensitive drum can be prevented with permitting cleaning of the transfer roller 4.

In addition, similarly to the foregoing embodiments, the time period during which the photosensitive drum is charged to the opposite polarity, is small, and therefore, the sensitivity deterioration of the photosensitive drum can be prevented.

As described in the foregoing, according to the present invention, the light image of the original is directed to the photosensitive member both during the image formation and during the non-image-formation, but the latent image which might be formed during the non-image-formation is not developed. Therefore, the necessity for the blank exposure light source or the blank exposure mechanism in the conventional system, has been eliminated.

Where the photosensitive member has an OPC photosensitive member, the potential of the photosensitive member during the non-image-formation is made to have a polarity the same as during the image formation by controlling the charger, so that the deterioration of the photosensitive member due to the opposite polarity can be avoided. Particularly, where the transfer means is in the form of an electrode type contactable to the photosensitive member, the transfer means may be supplied with a voltage having a polarity which is the opposite to the polarity in the normal image formation. This aspect of the present invention is effective to prevent the deterioration of the photosensitive member due to such a voltage application.

Although the foregoing description has been made with respect to an image forming apparatus having a reciprocable original carriage, but the present invention is not limited to this, and is applicable to the case wherein the illumination source and/or the reflection mirror or the like is reciprocated instead of the original carriage.

The transfer means may be in the form of a conventional corona discharger, an elastic blade or brush to which a voltage application is possible, as well as the electrode roller described in the foregoing.

The photosensitive member has been in the form of an OPC photosensitive member chargeable to the negative polarity, but it may be chargeable to the positive polarity.

As described in the foregoing, according to another aspect of the present invention, the surface of the image bearing member is controlled by an image bearing member surface control means so that the surface potential thereof has a predetermined polarity and has a predetermined level, and therefore, the sensitivity deterioration can be minimized even if a toner removing means applies a predetermined voltage to transfer means to transfer the toner from the transfer means to the image bearing member with the tendency of sensitivity deterioration of the image bearing member due to the polarity to which the image bearing member is charged. In addition, the toner deposition preventing means prevents toner deposition onto the image bearing member from other than transfer means, and therefore, the image exposure is effected on the image bearing member, the toner image is not formed. Therefore, there is no need of a particular mechanism for stopping the image exposure during the cleaning operation for the transfer means. Additionally, the unnecessary wasteful consumption of the toner can be avoided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing a toner image, movable along an endless path;

an original supporting platen for supporting an original;

an illumination source for illuminating an original on said supporting platen;

image forming means including charging means, an exposure optical system including a reciprocable part for directing a light image of the original on said supporting platen, developing means and transfer means, wherein the reciprocable part moves in a first direction, during image formation, in which the light image is directed to said image bearing member for image formation thereon and in a second direction, during non-image-formation, for returning the part;

wherein said illumination source emits light both during the image formation and during the non-image-formation to direct the light image to said image bearing member, and wherein a developing bias voltage in said developing means is switched depending on whether said apparatus is in the image formation or in the non-image-formation so that an image formed on said image bearing member is not developed by the developing means during the non-image-formation.

2. An apparatus according to claim 1, wherein lightness of the original is detected, and the developing bias is switched in accordance with the lightness.

3. An image forming apparatus comprising:

an photosensitive member for bearing a toner image, movable along an endless path;

an original supporting platen for supporting an original;

an illumination source for illuminating an original on said supporting platen;

image forming means including charging means, an exposure optical system including a reciprocable part for directing a light image of the original on said supporting platen, developing means and transfer means, wherein the reciprocable part moves in a first direction, during an image formation, in which the light image is directed to said photosensitive member for image formation thereon and in a second direction, during non-image-formation, for returning the part;

wherein said illumination source emits light both during the image formation and during the non-image-formation to direct the light image to said photosensitive member; a degree of charging by said charging means is switched depending on whether said apparatus in the image formation or in the non-image-formation so that the degree is lowered during the non-image-formation; and wherein a developing bias voltage in said developing means is switched depending on whether said apparatus is in the image formation or in the non-image-formation so that an image formed on said photosensitive member is not developed by the developing means during the non-image-formation.

4. An apparatus according to claim 3, wherein said charging means is in the form of a corona charger having a grid, and a bias voltage applied to the grid is used to switch the degree of charging.

5. An apparatus according to claim 3, wherein said charging means is in the form of an electrode, and a bias voltage applied to the electrode is used to switch the degree of charging.

6. An image forming apparatus comprising:

an photosensitive member for bearing a toner image, movable along an endless path;

an original supporting platen for supporting an original;

an illumination source for illuminating an original on said supporting platen;

image forming means including charging means, an exposure optical system including a reciprocable part for directing a light image of the original on said supporting platen, developing means and transfer means, wherein the reciprocable part moves in a first direction, during image formation, in which the light image is directed to said photosensitive member for image formation thereon and in a second direction, during non-image-formation, for returning the part;

wherein said illumination source emits light both during the image formation and during the non-image-formation to direct the light image to said photosensitive member., a degree of charging by said charging means is switched depending on whether said apparatus in the image formation or in the non-image-formation so that the degree is lowered during the non-image-formation; and wherein a developing bias voltage in said developing means is switched depending on whether said apparatus is in the image formation or in the non-image-formation so that an image formed on said photosensitive member is not developed by the developing means during the non-image-formation; and wherein said transfer means is in the form of an electrode for pressing a transfer material to said photosensitive member, and the electrode is supplied with a bias voltage including a polarity opposite to that of toner in said developing means during transfer operation, and is supplied with a bias voltage including a polarity the same as that of the toner during the non-image-formation.

7. An apparatus according to claim 6, wherein said transfer means is in the form of a roller rotatable in contact with said photosensitive member.

8. An image forming apparatus comprising:

an photosensitive member for bearing a toner image, movable along an endless path;

an original supporting platen for supporting an original;

an illumination source for illuminating an original on said supporting platen;

image forming means including charging means, an exposure optical system, including a reciprocable part for directing a light image of the original on said supporting platen, developing means and transfer means, wherein the reciprocable part moves in a first direction, during image formation, in which the light image is directed to said photosensitive member for image formation thereon and in a second direction, during non-image-formation, for returning the part;

wherein said illumination source emits light both during the image formation and during the non-image-formation to direct the light image to said photosensitive member a degree of charging by said charging means is switched depending on whether said apparatus in the image formation or in the non-image-formation so that the degree is lowered during the non-image-formation; and wherein a developing bias voltage in said developing means is switched depending on whether said apparatus is in the image formation or in the non-image-formation so that an image formed on said photosensitive member is not developed by the developing means during the non-image-formation; and wherein said transfer means is in the form of an electrode for pressing a transfer material to said photosensitive member, and the electrode is supplied with a bias voltage including a polarity opposite to that of toner in said developing means during transfer operation, and is supplied with a bias voltage including a polarity the same as that of the toner, and a polarity of charge on said photosensitive member is maintained to be the same as in the image formation, during the non-image-formation.

* * * * *

UNITED STATES PATENT AND TRADEMARK OFFICE

CERTIFICATE OF CORRECTION

PATENT NO. : 5,287,149

DATED : February 15, 1994

INVENTOR(S) : NORIHISA HOSHIKA

It is certified that error appears in the above-indentified patent and that said Letters Patent is hereby corrected as shown below:

In the drawings:

Figure 9,
"CHARG" should read --CHARGE--.

Column 1,
line 23, "machine" should read --machine,--.

Column 6,
line 28, "hot" should read --not--.

Column 7,
line 48, "BY" should read --By--.

Column 8,
line 8, "ar" should read --are--; and
line 37, "an" should read --a--.

Column 9,
line 62, "$V_{DC1}+_{VAC}$." should read --$V_{DC1}+V_{AC}$.--.

Column 11,
line 49, "but" should be deleted.

Column 12,
line 53, "an" should read --a--; and
line 64, "an" should be deleted.

UNITED STATES PATENT AND TRADEMARK OFFICE

CERTIFICATE OF CORRECTION

PATENT NO. : 5,287,149
DATED : February 15, 1994
INVENTOR(S) : NORIHISA HOSHIKA

It is certified that error appears in the above-indentified patent and that said Letters Patent is hereby corrected as shown below:

Column 13,
line 24, "an" should read --a--; and
line 43, "member.," should read --member;--.

Column 14,
line 13, "an" should read --a--;
line 20, "system," should read --system--; and
line 32, "member" should read --member;--.

Signed and Sealed this

Twenty-first Day of March, 1995

Bruce Lehman

*Attest:*

BRUCE LEHMAN

*Attesting Officer*

*Commissioner of Patents and Trademarks*